United States Patent [19]

Robins

[11] 4,305,611

[45] Dec. 15, 1981

[54] ADJUSTABLE GATE LATCH

[75] Inventor: Milton Robins, Marina Del Rey, Calif.

[73] Assignee: PTI-Dolco, Los Angeles, Calif.

[21] Appl. No.: 938,771

[22] Filed: Sep. 1, 1978

[51] Int. Cl.[2] ..... E05C 3/16

[52] U.S. Cl. ..... 292/238; 292/1; 292/341.19; 292/DIG. 60

[58] Field of Search ..... 292/DIG. 60, 235, 237, 292/341.18, 341.19, 1, 238; 248/295, 296, 287

[56] References Cited

U.S. PATENT DOCUMENTS

| | | | |
|---|---|---|---|
| 126,191 | 4/1872 | Dickey | 292/341.19 X |
| 148,662 | 3/1874 | Burr | 292/341.19 |
| 394,685 | 12/1888 | Fether | 292/341.19 X |
| 1,082,121 | 12/1913 | Herman | 292/294 |
| 1,116,091 | 11/1914 | McDonald | 248/295 A |
| 1,852,854 | 4/1932 | Norring | 292/341.19 |
| 2,144,075 | 1/1939 | Mora | 292/341.18 X |
| 2,221,532 | 11/1940 | Westerheim | 292/341.18 |
| 2,275,760 | 3/1942 | Hoffman | 292/341.19 |
| 2,673,771 | 3/1954 | Krewson | 248/287 X |
| 2,931,612 | 4/1960 | Grober | 248/295 A X |
| 3,266,831 | 8/1966 | Banse | 292/235 X |
| 3,433,518 | 3/1969 | Foltz | 292/238 |
| 4,058,333 | 11/1977 | Roe et al. | 292/172 |

FOREIGN PATENT DOCUMENTS

| | | | |
|---|---|---|---|
| 5169 | of 1915 | United Kingdom | 292/341.19 |

*Primary Examiner*—Richard E. Moore
*Attorney, Agent, or Firm*—J. B. McGuire

[57] ABSTRACT

A gate latch in which a latch bar and/or latch body are adjustably mountable so as to allow repositioning thereof when such repositioning might be required, for example, as a result of misalignment of the gate structures due to sagging, etc. The locking bar may be provided with a plate fixed to a gate structure and have a plurality of paired apertures which are alignable with a pair of apertures in the bar. Thus, the locking bar may be adjustably positioned with respect to any given pair of apertures on the plate. The latch body may be adjustably mounted in a housing mounted on a gate structure. The housing may have portions which overlap the normal mounting flanges on the latch body. A pair of oppositely directed, opposed bolts may be threadedly mounted in flanges on the housing so as to cooperate with opposed surfaces on the latch body. When the body is to be vertically adjusted, one bolt can be loosened and the other tightened. Alternatively, the overlapping portions of the housing may frictionally grip the latch body flanges, thus holding the body but allowing it to be adjusted vertically, for example, by being tapped with a hammer. Flanges and/or overlapping portions may be provided with knurling or other surface roughening to inhibit inadvertent vertical movement of the latch body.

4 Claims, 7 Drawing Figures

ADJUSTABLE GATE LATCH

BACKGROUND OF THE INVENTION

Gate latches have been employed for a long time to latch a gate when it is pushed to a closed position and to hold it in the closed position against inadvertent opening. In many instances, such gate latches have comprised a latch bar which may be mounted by a pair of screws on a gate structure, such as the gate or the post against which it closes. A latch body may be fixed to the other gate closure in alignment with the latch bar. A latch lever, pivotally mounted in the latch body, may be actuated by contact with the latch bar to move to an elevated position until such time as the latching surface of the lever drops over the bar and thus captures it between the latching surface and the inner end of the body. Thus, the gate can be held in the closed position.

Over a given period of time, nearly any given gate will begin to sag or become misaligned with respect to its adjacent post. Such distortion might be caused, for example, by weathering, weakening of the hinges, warping of the wood, etc. When this occurs, the latch bar will no longer be properly aligned with the latch body. Consequently, it will be quite difficult to latch the gate in the closed position and thus prevent unauthorized entry to the area being protected by the gate.

In the past, in order to prevent such misalignment, a substantially continuous maintenance program had to be performed on the gate. Alternatively, it was necessary to realign the bar and the latch body by repositioning at least one of them. In many instances, such repositioning resulted in a weakening of the wood of the gate structure as a result of the formation of a plurality of screw holes in the wood.

In fact, when such repositioning was required in the past, it was often required only to a very slight extent. Consequently, the closeness of the old fastener holes to the new fastener holes resulted in a significant weakening of the gate structure. Often, in fact, the weakening was so extensive that it became substantially impossible to firmly remount the element being adjusted. Consequently, it has become extremely desirable to provide a device which will allow the bar and/or body to be repositioned on their respective gate structures without weakening the gate.

SUMMARY OF THE INVENTION

The present invention relates to a structure which allows the bar and/or body to be vertically adjusted, relative to one another as well as relative to the gate structure upon which it is mounted.

More specifically, in the preferred embodiment of this invention, a plate having a plurality of pairs of mounting holes may be mounted on the gate structure to which the locking bar would previously have been fixed. Thus, the locking bar can be aligned and fastened to any of the pairs of apertures in the plate. As a result, the vertical position of the locking bar can be adjusted from time to time without weakening the wood by generating new apertures.

The present invention also foresees the possibility of mounting the latch body in a housing, which housing is fixed to one of the gate structures. The housing may be provided with overlapping sections, between which the normal mounting flanges of the latch body may be captured. Consequently, when it is desired to adjust the vertical position of the latch body relative to the gate structure, it need only be moved relative to the overlapping portions of the housing. Of course, those skilled in the art will realize that the present invention relates to a gate latch device which is normally used in such a manner as to be mountable in a vertical plane such that the latch bar is moved in a horizontal plane to latch the gate. Of course, those skilled in the art will also realize that the present invention could be utilized in any given plane, so long as the latch lever is mounted to cooperate with the latch bar for locking and unlocking two relatively movable structures.

With respect to that portion of the inventive concept relating to the vertically adjustable mounting of the body, in one embodiment of the invention a pair of opposed, preferably concentric bolts may be provided to bear against opposed surfaces of the body and allow it to be longitudinally adjusted. Thus, the body can be repositioned by loosening one of the bolts and tightening the other. When both bolts are tightened against the body, they will prevent inadvertent movement of the body relative to the fixed housing.

In another embodiment of the invention, the overlapping portions of the housing may be compressed to frictionally grip the mounting flanges of the body. Thus, the body can be moved up or down, relative to the housing and the gate structure, merely by using a hammer to tap the body within the housing. If desired, the mounting flanges of the body and/or certain portions of the housing can be knurled or otherwise roughened to prevent inadvertent movement of the body.

Upon reading the following detailed description, taken together with the accompanying drawing, those skilled in the art will quickly realize that the present invention may be employed in a wide variety of structures and embodiments, many of which may not even resemble that depicted and described here. Nevertheless, such additional embodiments may easily be found to employ the spirit and scope of the present invention which is defined in the claims.

DETAILED DESCRIPTION

Figure 1:
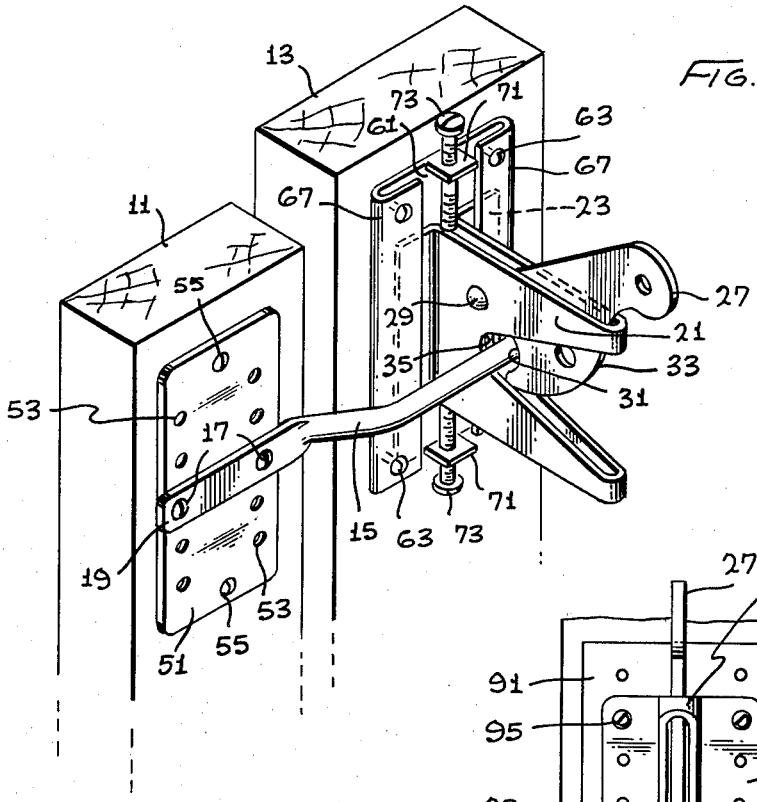
FIG. 1 comprises an isometric view of a gate latch formed in accordance with the present invention.

As shown in FIG. 1, a pair of cooperating gate structures 11 and 13 are generally depicted. It should be borne in mind that either of these structures may be the gate, per se, and the other may be the post or other structure against which the gate closes. Also, it should be borne in mind that the present invention is not in any way intended to be restricted to use with gates, but can be employed to releasably latch together any cooperating, relatively movable structures.

In any event, as depicted in the drawing, a latch bar 15 may be suitably mounted to the gate structure 11 by means of a pair of bolts or screws 17 which may be passed through a pair of apertures in a flattened end 19 of the bar.

To the other gate structure 13, a latch body 21 may be attached, having a pair of coplanar, oppositely directed mounting flanges 23. A latch lever or striker arm 27 may be pivotally mounted to the body 21 by any suitable means, such as a rivet 29. The latch lever 27 may be provided with a leading edge 33 for cooperation with the bar 15 to pivot the lever 27 upwardly when the gate is being closed, and a latching surface 31. Thus, when the gate is latched, the bar 15 will be captured between the latching surface 31 and a cooperating inner recess surface 35 in the body.

Of course, those skilled in the art will realize that the structure described thus far is well-known and, in and of itself, is not the present invention but only comprises a portion thereof.

Normally, when the latch bar and latch body are first mounted on their respective gate structures, they are so mounted as to be properly aligned and to allow the gate to be latched in a closed position when the respective structures 11 and 13 are properly moved relative to one another. On the other hand, after some period of time when the gate has weathered, warped, sagged, etc., the bar and the recess in the housing 21 leading to the inner surface 35 becomes misaligned to some extent, thus inhibiting the proper latching of the gate when it is moved to the closed position. If the gate is being used, for example, as part of the fencing around a swimming pool, such misalignment may have a disastrous effect by allowing small children to get into the pool area without proper supervision. In the past, it was necessary to remove the mounting bolts or screws for either the bar or the housing, or both, and then reposition the bolt or housing, reinstalling the bolts or screws. Not only was this a cumbersome task, but it also weakened the gate structure or structures by creating additional holes in the wood. In fact, if the new holes were close enough to the old ones, the wood might become cracked or damaged to such an extent that the latch structure concerned would not remain properly mounted.

In accordance with the present invention, structure is provided to allow the bar and/or the housing to be vertically adjusted without requiring the formation of new holes in the wood. Of course, the term "vertical" is used freely since those skilled in the art will realize that the present invention could very well have horizontal or other angularly related applications.

As shown, the bar 15 may be mounted on its respective gate structure 11 by means of a generally rectangular plate 51 which may be provided with a plurality of paired apertures 53. Preferably, the apertures 53 are spaced apart a distance equal to the spacing of the apertures in the flattened end 19 of bar 15. Consequently, bolts 17 may be passed through the apertures in the bar 15 and threaded into the apertures 53 in plate 51. In turn, plate 51 may be fixed to the gate structure 11 by any suitable means such as screws 55. Thus, when it is desired to reposition the bar 15, it is only necessary to remove the bolts 17, reposition the bar against the plate with respect to a different pair of apertures 53, and reinstall the bolts.

Also as illustrated in FIG. 1, the latch body 21 may be suitably mounted within a housing 61 which, in turn, may be fastened to the gate structure 13 by any suitable means such as screws 63.

Figure 3:
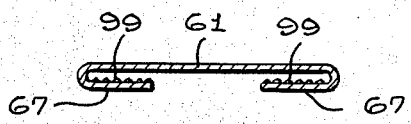
FIG. 3 comprises a sectional view of the latch housing shown in FIG. 2, as seen along a line 3—3 thereof.

Housing 61 may be generally "C" shaped (as seen in FIG. 3, for example) so as to have overlapping portions 67, within which flanges 23 of the body 21 may be captured and retained in the manner illustrated.

A pair of flanges 72 may be provided at opposite ends of the housing 61 so as to allow the threaded passage of bolts 73 therethrough. As shown, bolts 73 may, if desired, be coaxial and oppositely directed against opposed surfaces, i.e., the top and bottom surfaces, of the body 21. Thus, when it is desired to adjust the position of the body 21 relative to the housing 61, one of the bolts 73 can be backed off or away from the body and the other turned so as to move toward the bolt thus backed off. In other words, the body 21 may be fixedly held between the bolts 73 as well as adjusted by the bolts with respect to the housing 61.

Figure 2:
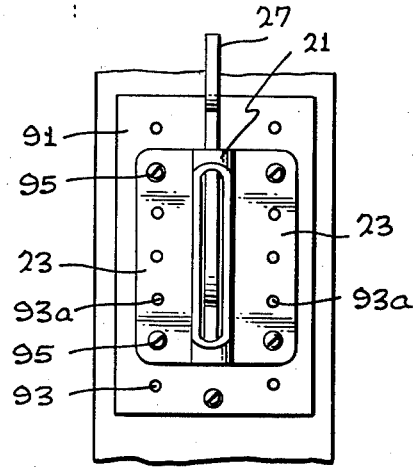
FIG. 2 comprises an elevation view of a second embodiment of a portion of the gate latch shown in FIG. 1, and, more particularly, the latch body portion thereof.
Figure 4:
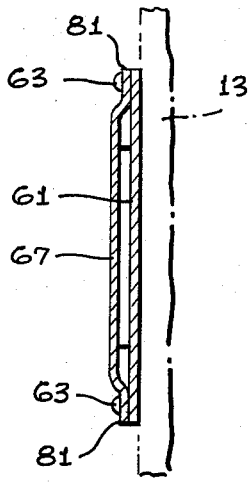
FIG. 4 comprises a sectional view of the latch housing shown in FIG. 2, as seen along a line 4—4 thereof.

As seen in in FIG. 2, a second, slightly different embodiment of the latch body mounting structure has been illustrated. As seen in that figure as well as in FIG. 4, those elements which are substantially identical to the elements depicted and described in FIG. 1 have been provided with identical reference numerals and no further description thereof is believed to be necessary. In this alternate embodiment of the invention, which may be employed with the embodiment of FIG. 1, if desired, or with any similar embodiment, the opposite ends 81 may be pinched or squeezed against the back wall of the housing 61, thus facilitating passage of the mounting screws 63, as well as positively preventing removal of the body flanges 23 from within the overlapping sections 67. The pinching or squeezing of the ends 81 can be accomplished either in the formation of the housing 61 (after the body 21 has been installed therein, of course) or at the time screws 63 are threaded into the wood of gate structure 13.

Figure 5:
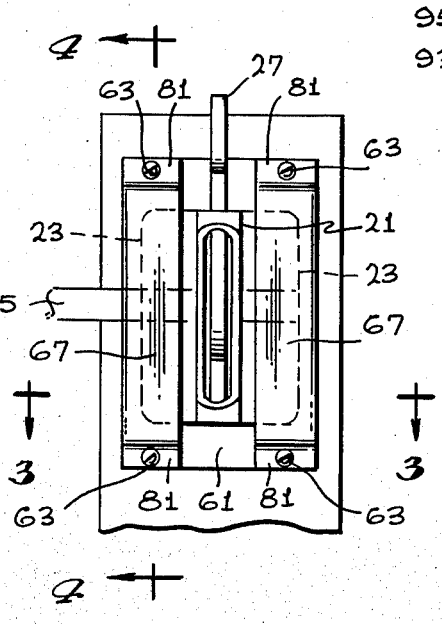
FIG. 5 comprises a view, similar to FIG. 2, of a third embodiment of the present invention, and specifically with respect to the mounting of the latch body.

Turning now to FIG. 5, a slightly different embodiment of structure for mounting the latch body 21 has been illustrated. Again, the structural elements which are substantially identical to those depicted in FIG. 1 have been provided with identical identification numerals and no description thereof need be repeated now.

In this embodiment, a plate 91 may be provided which, if desired, may be quite similar to the plate 51 upon which bar 15 was depicted as being mounted in FIG. 1. In other words, plate 91 may be provided with a plurality of paired apertures 93. Similarly, the flanges 23 may be provided with a plurality of paired apertures **93*a* which can be selectively coaxially aligned with the apertures 93 in plate 91. Consequently, a plurality of bolts 95 may be passed through apertures 93*a* in the mounting flanges 23 and threaded into apertures 93 in the plate 91. Thus, when it is desired to relocate the body 21 relative to its respective gate structure 13, it is a simple matter to remove the bolts 95, reposition the body with respect to the plate 91 such that new apertures 93*a* and 93** are aligned, and then reinstall the bolts.

Figure 6:
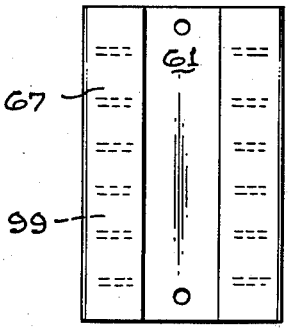
FIGS. 6 and 7 depict the concept of knurling or roughening the respective adjacent surfaces of the latch body and/or housing.
Figure 7:
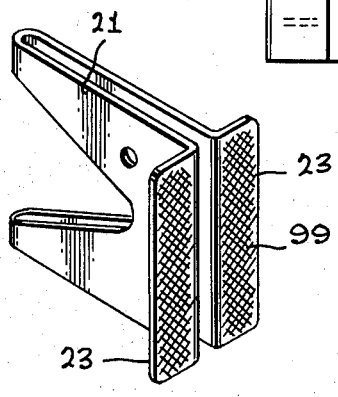

With respect to FIGS. 3, 6, and 7, it can be seen that, if desired, various surfaces of the body 21 and housing 61 may be provided with knurling or surface roughening 99. In each of the above-described embodiments, such surface roughening or knurling may be provided to prohibit inadvertent relative movement between the body 21 and the plate 61. In the embodiment of FIGS. 1 and 2, and particularly with respect to FIG. 2, if the overlapping portions 67 are squeezed tightly enough against the back portion of the housing 61, the mounting flanges 23 of the body 21 will be frictionally gripped within the overlapping portions, i.e., between the front and back portions of the housing 61. Thus, in order to adjust the position of the body relative to the housing, it will only be necessary for the home owner, installer, etc., to tap the body with a hammer on its upper or lower surface, thus moving the body within the housing.

If the housing and/or body are provided with knurled or roughened surfaces, such relative movement can only be accomplished by proper force application on the body. In other words, the knurling will inhibit or positively prohibit relative movement between the body and the housing unless such movement is positively accomplished with a hammer or like tool.

Having now reviewed the preferred embodiments of the present invention, together with the accompanying drawing, those skilled in the art will realize that the spirit and scope of the present invention vastly exceeds that depicted and described here and is limited only to the extent set forth in the following claims.

I claim:

1. Apparatus for adjusting the relative positions of a gate latch assembly including a latch bar having a pair of spaced mounting apertures and a latch body having a latch lever pivotally mounted thereon and a pair of coplanar, oppositely directed mounting flanges, comprising:

plate means;

means for mounting said plate means upon a gate structure;

a plurality of paired apertures at predetermined spaced locations in said plate means, each said pair of apertures being spaced apart a distance equal to the spacing of the apertures in said latch bar;

means for extending through said latch bar apertures and into an aligned pair of said plate apertures for fixing said bar to said plate; and housing means having means for fixing said housing means to a gate structure, means for overlapping and capturing said body mounting flanges, and means for allowing relative movement between said overlapping and capturing means and said flanges while inhibiting inadvertent relative movement therebetween.

2. In a gate latch including a latch bar and a latch body, each mountable upon a separate, cooperable gate structure, and a latch striker arm pivotally mounted in said latch body, the improvement comprising means for adjustably mounting said latch body upon its respective gate structure including housing means mountable upon a gate structure and having means for frictionally holding said latch body against movement relative thereto while allowing such relative movement upon the application of impact force against said latch body in a direction substantially perpendicular to the direction of normal locking cooperation of said latch bar and said latch body; and means for adjustably mounting said latch bar on the other cooperable gate structure including plate means having means thereon for releasably fixing the latch bar in a selected position relative to the plate means.

3. In a gate latch including a latch bar and a latch body, each mountable upon a separate, cooperable gate structure, and a latch striker arm pivotally mounted in said latch body, the improvement comprising:

means for adjustably mounting said latch body upon its respective gate structure including housing means, mountable upon a gate structure and having means for supporting said latch body and for preventing any substantial movement of said latch body relative to said housing means except along a predetermined axis relative to said housing means;

positioning means mounted on one of said housing means and said supporting means for adjustably positioning said latch body relative to said housing means including a pair of adjustable bolt means operatively connected to said housing means so as to bear against opposed surfaces of said latch body;

a gate latch bar which has at least two mounting apertures at spaced locations thereon and having means for adjustably mounting said gate latch bar, comprising:

plate means;

means for mounting said plate means upon a gate structure;

a plurality of paired apertures at predetermined spaced locations in said plate means, each of said pair of apertures being spaced apart a distance equal to the spacing of the apertures in said latch bar; and means extending through coaxially aligned apertures in said latch bar and plate means for releasably fixing said latch bar to said plate means.

4. In a gate latch including a latch bar and a latch body, each mountable upon a separate, cooperable gate structure, and a latch striker arm pivotally mounted in said latch body, the improvement comprising:

means for adjustably mounting said latch body upon its respective gate structure including housing means mountable upon a gate structure and having means for frictionally holding said latch body against movement relative thereto while allowing such relative movement upon the application of impact force against said latch body in a direction substantially perpendicular to the direction of normal locking cooperation of said latch bar and said latch body;

a gate latch bar which has at least two mounting apertures at spaced locations thereon and having means for adjustably mounting said gate latch bar comprising:

plate means;

means for mounting said plate means upon a gate structure;

a plurality of paired apertures at predetermined spaced locations in said plate means, each of said pair of apertures being spaced apart a distance equal to the spacing of the apertures in said latch bar; and means extending through coaxially aligned apertures in said latch and plate means for releasably fixing said latch bar to said plate means.

* * * * *